United States Patent [19]

Oshizawa et al.

[11] Patent Number: 4,679,116

[45] Date of Patent: Jul. 7, 1987

[54] CURRENT CONTROLLING DEVICE FOR ELECTROMAGNETIC WINDING

[75] Inventors: Hidekazu Oshizawa; Masami Kondoh, both of Higashimatsuyama, Japan

[73] Assignee: Diesel Kiki Co., Ltd., Tokyo, Japan

[21] Appl. No.: 793,240

[22] Filed: Oct. 31, 1985

[30] Foreign Application Priority Data

Dec. 18, 1984 [JP] Japan ..... 59-265415

[51] Int. Cl.[4] ..... H01H 47/32

[52] U.S. Cl. ..... 361/154; 361/194

[58] Field of Search ..... 361/153, 154, 160, 194

[56] References Cited

U.S. PATENT DOCUMENTS

| | | | |
|---|---|---|---|
| 4,345,296 | 8/1982 | Breitling | 361/154 |
| 4,358,812 | 11/1982 | LoCascio et al. | 361/154 X |
| 4,452,210 | 6/1984 | Sasayama et al. | 361/154 X |
| 4,473,861 | 9/1984 | Kosak et al. | 361/154 X |
| 4,516,185 | 5/1985 | Culligan et al. | 361/154 |
| 4,536,818 | 8/1985 | Nielsen | 361/154 |

*Primary Examiner*—Michael L. Gellner

*Attorney, Agent, or Firm*—Birch, Stewart, Kolasch & Birch

[57] ABSTRACT

A current controlling device comprises an input circuit for receiving a driving signal, means for supplying a first reference voltage or a second reference voltage lower than the first reference voltage, a detecting resistor for detecting current flowing through an electromagnetic winding, and means for supplying the electromagnetic winding with a starting current and a holding current. The starting current initially rises then is maintained at a constant value based upon the detected voltage of the detecting resistor and the first reference voltage. The second reference voltage is supplied in place of the first reference voltage after a predetermined period of time and continues to be supplied until the driving signal ends. The holding current is maintained at a constant value lower than said constant value of the starting current based upon the detected voltage and the second reference voltage. Both the first and second reference voltages are controlled to be constant voltages.

7 Claims, 5 Drawing Figures

CURRENT CONTROLLING DEVICE FOR ELECTROMAGNETIC WINDING

BACKGROUND OF THE INVENTION

The present invention relates to a current controlling device for an electromagnetic winding. In particular, it relates to a current controlling device for controlling a starting current and a holding current supplied to an electromagnetic winding of a solenoid valve and the like.

To Drive an electromagnetic appliance such as a solenoid valve, an electromagnetic nozzle or an electromagnetic relay, in general, a large starting current initially is supplied to an electromagnetic winding thereof, and then, the current is reduced to a controllable holding current lower than the starting current in order to hold the condition after start up.

FIG. 1 shows a prior controlling device to perform the above current control, and FIG. 2 shows a characteristic curve of current flowing through an electromagnetic winding of the circuit in FIG. 1. This current controlling device has been shown in the U.S. Pat. No. 4,345,296.

In those figures, when a driving signal 1 is not supplied, an input terminal 2 has zero potential. Consequently, transistors 3 and 5 are in off state, and a transistor 4 is in on state. Therefore, the current does not flow through an electromagnetic winding 6. A comparator 7 at its (+)input terminal is grounded through resistors 8 and 9, and a (−)input terminal thereof is supplied with a source voltage by means of an on state of a transistor 10. Therefore, the output level of the comparator 7 is in L level (low level), and a transistor 11 is cut off. If the driving signal 1 appears at the input terminal 2 at the time point $t_0$ of FIG. 2, the potential of the input terminal 2 becomes high, thus the transistors 3, 5 are conductive, and the transistors 4, 10 are cut off. When the transistor 10 is cutt off, the (−)input terminal of the comparator 7 is supplied with the source voltage divided by resistors 12 and 13. When the transistor 5 is conductive, a starting current IA flows through the electromagnetic winding 6 and rises gradually, thereby causing the voltage drop across the resistor 9 to increase. If the starting current IA rises to the maximum value $IA_{max}$, the voltage applied to the (+)input terminal of the comparator 7 exceeds the voltage applied to the (−)input terminal thereof, and the output level of the comparator 7 becomes H level (high level), thereby causing the transistor 11 to be conductive. Therefore, a zener diode 14 is inserted in parallel into the series connection of the base-emitter circuit of the transistor 5 and the resistor 9. Consequently, when the zener voltage is applied to said series connection, the current which flows through the electromagnetic winding 6 decreases from $IA_{max}$ to a lower holding current IH. If the driving signal 1 comes to an end, the potential at the input terminal 2 becomes zero, and the circuit is returned to the initial condition.

However, the prior controlling circuit has disadvantages as described below.

According to the prior art, since the starting current IA rises freely to the maximum value $IA_{max}$ thereof, the heat loss in the electromagnetic winding increases, and undesirable heating may be produced. That is to say, in order to reduce the heat loss, it is preferable that the maximum value $IA_{max}$ of the starting current be a lower value. In the prior art, however, the reduction of the maximum value $IA_{max}$ is accompanied by narrowing of the starting period T, and results in obstruction of the driving of, for example, a solenoid valve to be controlled. Consequently, in the prior art, since the reduction of the maximum value $IA_{max}$ is difficult, heat loss is increased because of the large starting current.

Also, in the prior art, the large current flows until the starting current attains the maximum value $IA_{max}$ even if the solenoid value has been completely opened before the end of the starting period T, causing heat loss to increase still more.

Further, in the prior art, since the reference voltage of the comparator 7 is obtained by dividing the source voltage by the resistors 12 and 13, the reference voltage is easily varied with the fluctuation of the source voltage. Therefore, the characteristics of the current flowing through the electromagnetic winding vary, and the stable control of the solenoid valve may be obstructed.

SUMMARY OF THE INVENTION

It is an object, therefore, of the present invention to overcome the disadvantages and limitations of prior current controlling devices by providing a new and improved current controlling device.

Another object of the present invention is to provide current controlling device which can reduce a heat loss in an electromagnetic winding.

Still another object of the present invention is to provide a current controlling device which can control an electromagnetic appliance using an electromagnetic winding stably in spite of fluctuation of a source voltage.

The above and other objects are attained by a current controlling device comprising an input circuit for receiving a driving signal; reference voltage supply means for supplying a first reference voltage or a second reference voltage lower than the first reference voltage, said first and second reference voltage being controlled to constant voltages, respectively, and said second reference voltage being supplied until the end of the driving signal and after a predetermined time from the input of the driving signal, instead of said first reference voltage; a detecting resistor for detecting the current flowing through the electromagnetic winding; and current control means for supplying the electromagnetic winding with the starting current and the holding current, the starting current being regulated to a predetermined value as it rises on the basis of the detected voltage of said detecting resistor and said first reference voltage, and the holding current being regulated to another predetermined value lower than said predetermined value on the basis of said detected voltage and said second reference voltage.

BRIEF DESCRIPTION OF THE DRAWINGS

The foregoing and other objects, features, and attendant advantages of the present invention will be appreciated as the same become better understood by means of the following description and accompanying drawings wherein.

DETAILED DESCRIPTION OF THE INVENTION

Figure 3:
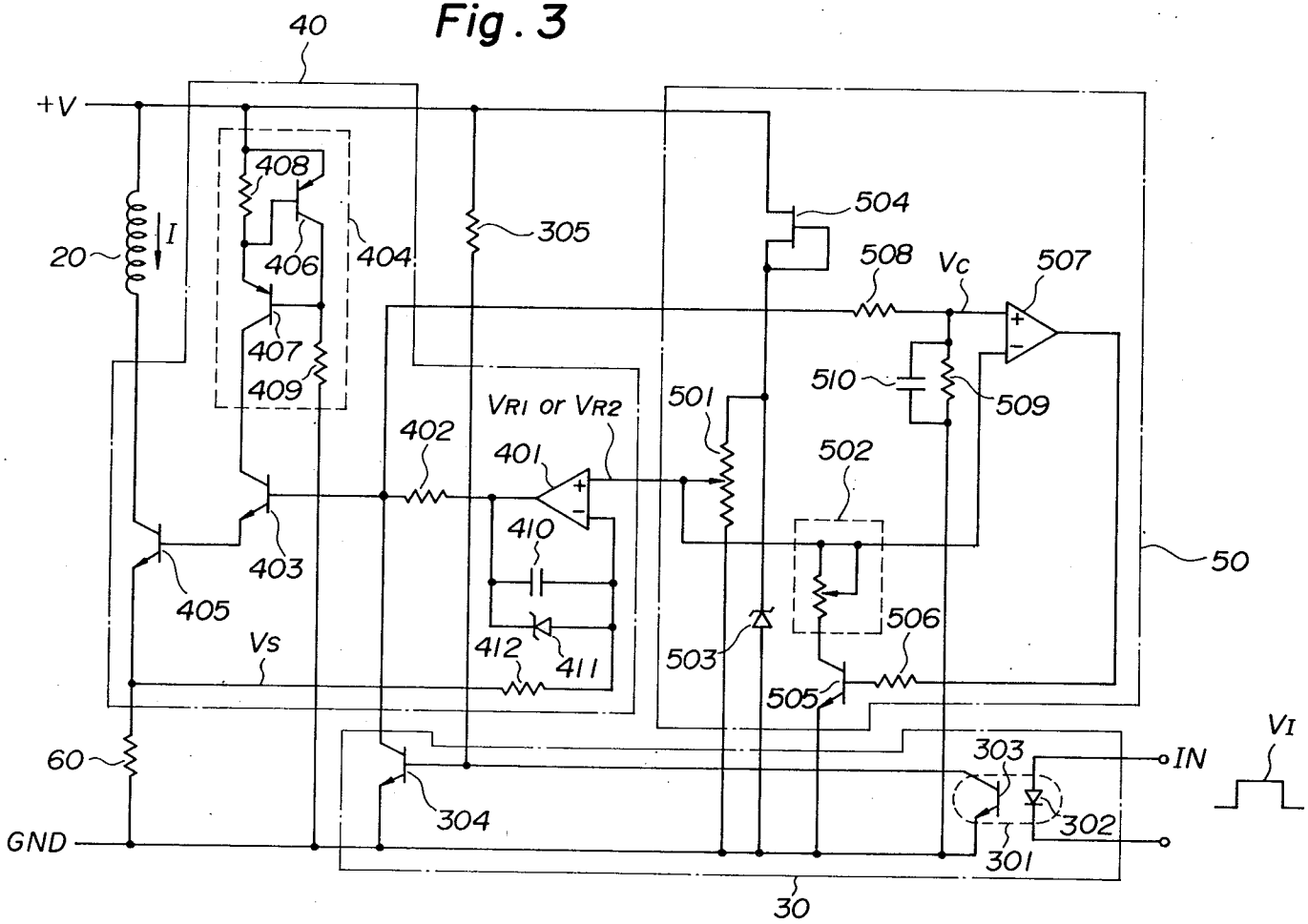
FIG. 3 is a circuit diagram of a current controlling device according to the present invention.

FIG. 3 shows a current controlling device for driving an electromagnetic winding 20 of a solenoid valve. Even when the electromagnetic winding 20 is applied to an electromagnetic nozzle or an electromagnetic relay, the device in FIG. 3 can be used.

The current controlling device comprises an input circuit 30 for receiving a driving signal VI, current control means 40 for controlling the current flowing through the electromagnetic winding 20, reference voltage supply means 50 for supplying the current control means 40 with a first reference voltage $V_{R1}$ and a second reference voltage $V_{R2}$ lower than the first reference voltage $V_{R1}$, and a detecting resistor 60 for detecting the current which flows through the electromagnetic winding 20.

An input terminal IN of the input circuit 30 is connected to a photo diode 302 of the photo coupler 301. A photo transistor 303 of the photo coupler 301 at its emitter is grounded, and its collector is connected to a base of switching transistor 304. The base of the transistor 304 is also connected through a resistor 305 to the power source line. An emitter of the transistor 304 is grounded, and its collector is introduced in the current control means 40. The transistor 304 is conductive when the driving signal VI is not supplied, because the photo transistor 303 is cut off. On the other hand, when the driving signal VI is supplied, the transistor 304 is cut off because the photo transistor 303 is conductive.

The collector of the switching transistor 304 is connected through a resistor 402 to an output side of a comparison amplifier 401 of the current control means 40. The junction point between the collector of the transistor 304 and the resistor 402 is connected to a base of a forward-stage driving transistor 403. The transistor 403 constitutes a driving circuit of the electromagnetic winding 20 together with a current limiting circuit 404 and a rearward-stage driving transistor 405. The collector of the forward-stage driving transistor 403 is connected to the current limiting circuit 404, and its emitter is connected to the base of the rearward-stage driving transistor 405. The current limiting circuit 404 which comprises two transistors 406, 407 and two resistors 408, 409 limit the collector current of the transistor 403. By means of this limiting, extreme saturation of the rearward-stage driving transistor 405 is prevented. A collector of the transistor 405 is connected to one end of the electromagnetic winding 20, and its emitter is connected to one end of the detecting resistor 60. The other end of the electromagnetic winding 20 is connected to the power source line. The other end of the detecting resistor 60 is grounded. The current I flowing through the electromagnetic winding 20 is supplied by the rearward-stage driving transistor 405. The base current of the transistor 405 is the emitter current of the forward-stage driving transistor 403. The base current of the transistor 403 is supplied from the comparison amplifier 401.

The comparison amplifier 401 constitutes a comparison amplifier circuit together with a resistor 402, a capacitor 410, a zener diode 411 and a resistor 412. Preferably, the comparison amplifier 401 is composed of an operational amplifier of which input stage transistors are PNP type (for example, μPC1251C of Nippon Electric Co., Ltd.). According to such an operational amplifier, the lowest value of the input voltage range is 0 (V) since there is no retained voltage in the input stage. While, according to an operational amplifier which has NPN transistors in its input stage, the lowest value of the input voltage range is higher than 0 (V) because of residual voltage in the input stage. Therefore, if the comparison amplifier 401 is composed of the preferable operational amplifier, the relative resistance value of the detecting resistor 60 to the electromagnetic winding 20 can be decreased, for example, to 1/5 or less as compared with the operational amplifier having the NPN transistors in the input stage, since it is not necessary that the voltage drop across the detecting resistor 60 be enlarged. Therefore, the power consumption of the detecting resistor 60 and the heat loss thereof can be reduced. Thus, not only the power loss of the detecting resistor 60 but also the consideration for a heat resisting property will be decreased.

The comparison amplifier 401 at its (−)input terminal is connected through the resistor 412 to the point between the transistor 405 and the resistor 60. Therefore, the (−)input terminal of the amplifier 401 is supplied with the detected voltage $V_s$ corresponding to the current I flowing through the electromagnetic winding 20. A feedback circuit including the parallel connection of the capacitor 410 and the zener diode 411 is inserted between the (−)input terminal and the output terminal of the comparison amplifier 401. The capacitor 410 is for the phase compensation of the amplifier 401. The zener diode 411 functions as the voltage limiter of the amplifier 401. The zener diode 411 suppresses the overbias to the forward-stage driving transistor 403 at the starting operation, and reduces the overshooting of the current I. The (+)input terminal of the amplifier 401 is connected to the reference voltage supply means 50, and receives the first reference voltage $V_{R1}$ or the second reference voltage $V_{R2}$ from the supply means 50. The output of the amplifier 401 is applied to the base of the transistor 403 so that the difference between the first reference voltage $V_{R1}$ or the second reference voltage $V_{R2}$ and the detected voltage $V_S$ becomes zero.

The (+)input terminal of the comparison amplifier 401 is connected to a resistor 501 of the reference voltage supply means 50 by means of a slider, and also connected to another resistor 502. The first reference voltage $V_{R1}$ is supplied by the resistor 501. The second reference voltage $V_{R2}$ is supplied by the parallel insertion of the resistor 502 to the resistor 501. The resistor 501 is connected in parallel to a zener diode 503. The anode of the zener diode 503 is grounded, and the cathode thereof is connected through a constant-current FET 504 to the power source line. The other resistor 502 with its one end connected to the (+)input terminal of the amplifier 401 has the other end grounded through a collector-emitter circuit of a switching transistor 505. By means of such connection between the resistors 501, 502 and the zener diode 503, a constant voltage is applied to the resistors 501, 502. Therefore, the first reference voltage $V_{R1}$ and the second reference voltage $V_{R2}$ do not fluctuate even when the source voltage fluctuates.

The switching transistor 505 constitutes a switching means together with a resistor 506, a comparator 507, resistors 508, 509 and a capacitor 510. This switching means inserts the resistor 502 in parallel with the resistor 501, or separates the resistor 502 from the resistor 501. The resistors 508, 509 and the capacitor 510 constitute a time constant circuit. The base of the transistor 505 is connected through the resistor 506 to the output terminal of the comparator 507. The (+)input terminal of the comparator 507 is connected through the resistor 508 to the base of the forward-stage driving transistor 403, and also grounded through the parallel connection of the resistor 509 and the capacitor 510. Consequently, the (+)input terminal of the comparator 507 is supplied with an input voltage $V_C$ rising in accordance with the time constant determined by the resistors 508, 509 and the capacitor 510, when the transistor 304 is cut off. The (−)input terminal of the comparator 507 is connected to the (+)input terminal of the comparison amplifier 401. Therefore, the (−)input terminal of the comparator 507 is supplied with the first reference voltage $V_{R1}$ or the second reference voltage $V_{R2}$. The comparator 507 makes the transistor 505 conduct when the input voltage $V_C$ attains to the first reference voltage $V_{R1}$, and makes the transistor 505 cut off when the input voltage $V_C$ becomes the second reference voltage $V_{R2}$ or less. The resistor 502 is inserted in parallel with the resistor 501 when the transistor 505 is conductive. The resistor 502 is separated from the resistor 501 when the transistor 505 is cut off.

Figure 4:
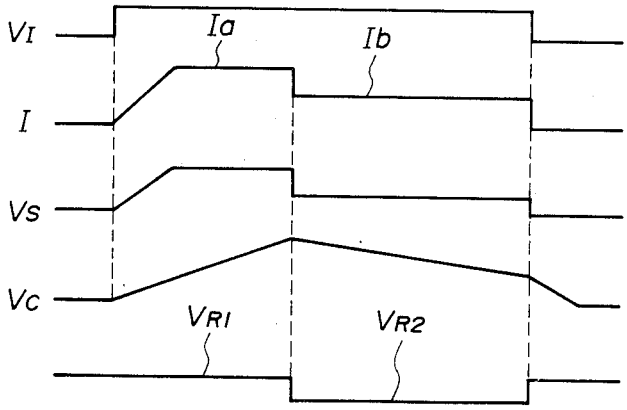
FIG. 4 is an operational time chart of the circuit of FIG. 3 according to the present invention.

FIG. 4 shows the operational time chart of the device of FIG. 3. The driving signal $V_I$, the current I, the detected voltage $V_S$, the input voltage $V_C$, the first reference voltage $V_{R1}$ and the second reference voltage $V_{R2}$ are shown in FIG. 4.

If the driving signal $V_I$ is not applied to the input terminal NI, the photo transistor 303 is in an off state, and the switching transistor 304 is conductive since the transistor 304 is supplied with base current through the resistor 305. Therefore, the base potential of the forward-stage driving transistor 403 is approximately 0 (V). Therefore, the current I which flows through the electromagnetic winding 20 is zero because the transistors 403 and 405 are not driven. On the other hand, since the input voltage $V_C$ applied to the (+)input terminal of the comparator 507 is approximately 0 (V), the switching transistor 505 is in off state. Consequently, the (+)input terminal of the amplifier 401 is supplied with the first reference voltage $V_{R1}$ by means of the resistor 501. The (−)input voltage of the amplifier 401 is zero because the current I is zero. Therefore, the output voltage of the amplifier 401 is saturated in the direction so that the amplifier 401 provides the current I with the electromagnetic winding 20. Since this saturation voltage is limited by the zener diode 411, the amplifier 401 is prevented from oversupplying the base current to the forward-stage driving transistor 403 when the transistor 304 is cut off, and the overshooting of the current I is suppressed.

If the driving signal $V_I$ is supplied to the input terminal IN, the photo transistor 303 is conductive. Therefore, the base potential of the switching transistor 304 becomes approximately zero, and the transistor 304 is cut off. Consequently, the base of the forward-state driving transistor 403 is supplied with the output of the amplifier 401, and then, the rearward-stage driving transistor 405 is driven. Accordingly, the starting current $I_a$ begins to flow through the electromagnetic winding 20. As shown in FIG. 4, the starting current $I_a$ rises freely until the detected voltage $V_S$ (or the voltage drop of the detecting resistor 60) rises to the first reference voltage $V_{R1}$, and then, the starting current $I_a$ is controlled so that the detected voltage $V_S$ corresponds to the first reference voltage $V_{R1}$. Consequently, the starting current $I_a$ is controlled to a constant value as shown in FIG. 4. This constant value is set to a current value lower than the maximum value $IA_{max}$ in FIG. 2.

When the switching transistor 304 is cut off, the input voltage $V_C$ applied to the (+)input terminal of the comparator 507 rises according to the time constant determined by the resistors 508, 509 and the capacitor 510. When the input voltage $V_C$ attains to the first reference voltage $V_{R1}$, the output of the comparator 507 inverts to the H level. Thus, the switching transistor 505 is conductive, and the resistor 502 is inserted in parallel with the resistor 501. Consequently, the second reference voltage $V_{R2}$, which is lower than the first reference voltage $V_{R1}$, is supplied to the amplifier 401 and the comparator 507.

The amplifier 401, therefore, reduces the mean output voltage so that the detected voltage $V_S$ corresponds to the second reference voltage $V_{R2}$. Thus, the current I is reduced to the holding current $I_b$, which is lower than the starting current $I_a$, as shown in FIG. 4.

The input voltage $V_C$ of the comparator 507 decreases in accordance with the reduction of the mean output voltage of the amplifier 401. However, since the reference voltage applied to the (−)input terminal of the comparator 507 changes into the second reference voltage $V_{R2}$, which is lower than the first reference voltage $V_{R1}$, the output level of the comparator 507 is not inverted. Therefore, the transistor 505 continues in the on state.

If the driving signal $V_I$ ends, the switching transistor 304 becomes conductive again. Therefore, the driving transistor 403 and 405 are cut off, and the current I is zero. Since the input voltage $V_C$ becomes less than the second reference voltage $V_{R2}$ because of the on state of the transistor 304, the output of the comparator 507 inverts to the L level. Thus, the switching transistor 505 is cut off, and the first reference voltage $V_{R1}$ is supplied again to the amplifier 401 and the comparator 507.

Figure 1:
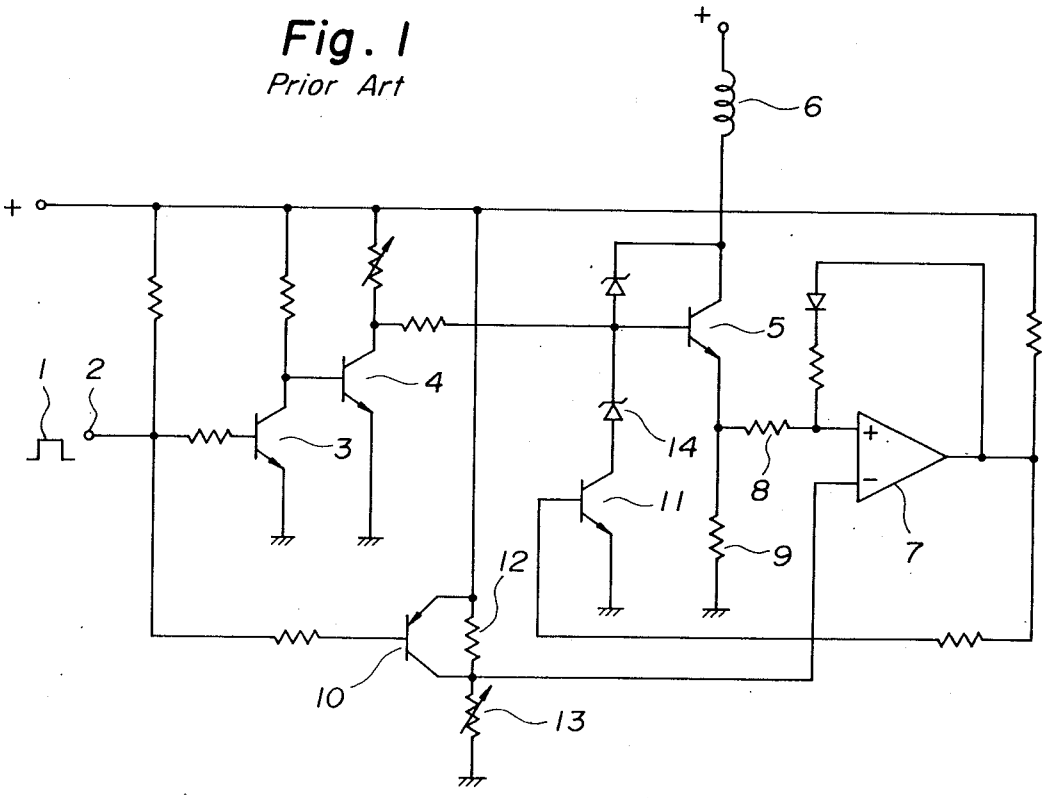
Fig. 1 Prior Art
FIG. 1 is a circuit diagram of a current controlling device in the prior art.
Figure 2:
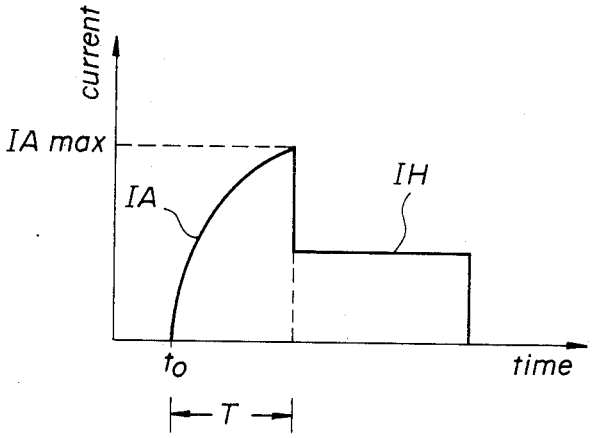
Fig. 2 Prior Art
FIG. 2 is a characteristic curve of current flowing through an electromagnetic winding of the circuit of FIG. 1.
Figure 5:
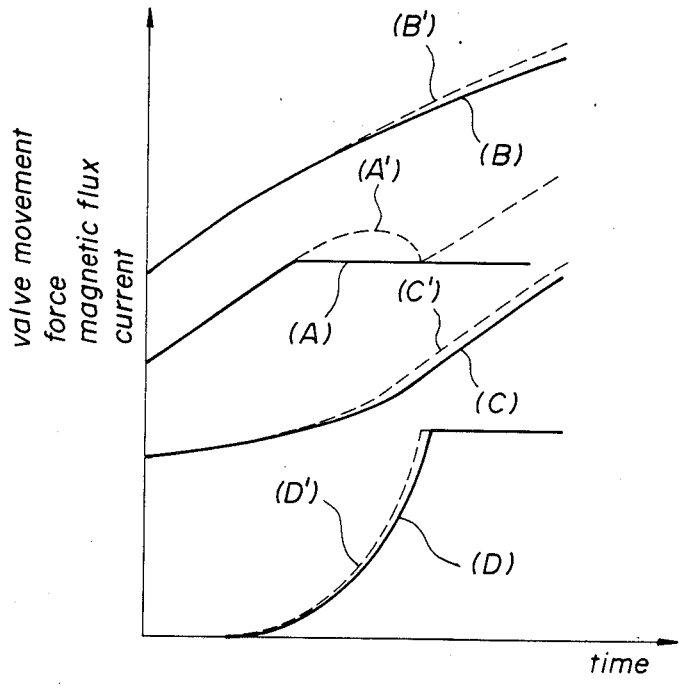
FIG. 5 shows starting characteristic curves given by the constant current control of the starting current shown in FIG. 4 and the non-control of the starting current shown in FIG. 2.

FIG. 5 shows starting characteristic curves given by the constant current control of the starting current according to the present invention shown in FIG. 4 and the non-control of the starting current shown in FIG. 2. In FIG. 5, the curve (A) shows the variation of the starting current given by the constant current control, and the curve (A') of the broken line shows that given by the non-control. The curve (B) shows the variation of the magnetic flux of electromagnetic winding given by the constant current control, and the curve (B') shows that given by the non-control. The curve (C) shows the variation of the generated force given by the constant current control, and the (C') shows that given by the non-control. The curve (D) shows the movement of the valve given by the constant current control, and the curve (D') shows that given by the non-control. As apparent from FIG. 5, even when the starting current is made constant as it rises, there is scarcely any difference with respect to the generated force and the valve movement between the constant current control and the non-control.

As described in detail, the current controlling device according to the present invention can reduce the heat loss in the electromagnetic winding, since the starting current is regulated to a constant value lower than the maximum value $IA_{max}$ as in the case where the starting current rises freely. Further, the present current controlling device can control an electromagnetic appliance stably even if the source voltage fluctuates, since the first and second reference voltages are controlled to constant voltages, respectively.

From the foregoing it will now be apparent that a new and improved current controlling device has been found. It should be understood of course that the embodiment disclosed is merely illustrative and is not intended limit to the scope of the invention. Reference should be made to the appended claims, therefore, rather than the specification as indicating the scope of the invention.

What is claimed is:

1. A current controlling device for an electromagnetic winding comprising:

an input circuit for receiving a driving signal;

reference voltage supply means, responsive to said driving signal, for supplying a first reference voltage or a second reference voltage lower than the first reference voltage, said first and second reference voltages being controlled at substantially constant respective values, said first reference voltage being supplied until a predetermined time after the receipt of said driving signal, said second reference voltage being supplied from said predetermined time after the receipt of said driving signal until said driving signal is no longer received;

a detecting resistor, connected to said electromagnetic winding, for detecting current flowing through said electromagnetic winding and providing a detected voltage representative thereof;

comparison amplifier circuit means, responsive to said driving signal, for supplying as an output a first analog control output or a second analog control output, said comparison amplifier circuit means receiving said detected voltage and either one of said first or second reference voltages, whichever is supplied by said reference voltage supply means, providing said first analog control output when receiving said first reference voltage, said first analog control output causing the difference between said first reference voltage and said detected voltage to become zero, and providing said second analog control output when receiving said second reference voltage, said second analog control output causing the difference between said second reference voltage and said detected voltage to become zero; and driving circuit means, responsive to said first and second analog control outputs, for controlling a starting current flowing through said electromagnetic winding at a substantially constant value in accordance with said first analog control output and for controlling a holding current flowing through said electromagnetic winding at another substantially constant value in accordance with said second analog control output, said holding current being lower in value than said constant value of said starting current.

2. A current controlling device according to claim 1, wherein said reference voltage supply means includes:

a time constant circuit that receives the output of said comparison amplifier circuit means during the period of said driving signal and provides a voltage signal which exceeds said first reference voltage after said predetermined time from the receipt of said driving signal, and provides a voltage signal which is less than said second reference voltage when said driving signal is no longer received, comparator means receiving the voltage signal of said time constant circuit and either one of said first or second reference voltages for providing a first control output indicative of switching from said first reference voltage to said second reference voltage when the voltage signal of said time constant circuit exceeds said first reference voltage and a second control output being indicative of switching from said second reference voltage to said first reference voltage when the voltage signal of said time constant circuit is below said second reference voltage, and reference voltage circuit means responsive to the output of said comparator means for providing said comparison amplifier circuit means and said comparator means with said first reference voltage if said second control output is received or second reference voltage if said first control output is received.

3. A current controlling device according to claim 2, wherein said reference voltage circuit means includes:

a first resistor one end of which is grounded and the other end of which is connected through a constant current field effect transistor to a power source line, a zener diode connected in parallel to said first resistor, a second resistor which can be inserted in parallel with said first resistor in order to provide said second reference voltage, and a switching transistor, its collector-emitter circuit being inserted in series with said second resistor and its base being connected to the output side of said comparator means, said switching transistor being conductive in response to said first control output of said comparator means and being cut off in response to said second control of said comparator means.

4. A current controlling device according to claim 1, wherein said input circuit includes:

a photo coupler for receiving said driving signal, a switching transistor, the base of said switching of transistor being connected to an output side of said photo coupler and the collector-emitter circuit of said switching transistor being inserted between the output side of said comparison amplifier circuit means and ground, and a resistor being inserted between the base of said switching transistor and a power source line, said switching transistor being cut off when said driving signal is received.

5. A current controlling device according to claim 1, wherein said driving circuit means includes:

a forward-stage driving transistor, the base of said forward-stage driving transistor being connected to the output side of said comparison amplifier circuit means, a current limiting circuit being inserted between the collector of said forward-stage driving transistor and a power source line, and a rearward-stage driving transistor having its collector-emitter inserted in series with said electromagnetic winding.

6. A current controlling device according to claim 1, wherein said comparison amplifier circuit includes a feedback circuit including a zener diode 1.

7. A current controlling device for an electromagnetic winding comprising:

an input circuit for receiving a driving signal;

reference voltage supply means, responsive to said driving signal, for supplying a first reference voltage or a second reference voltage that is lower in value than said first reference voltage, said first and second reference voltages being controlled at substantially constant respective values, said reference voltage supply means including, a first resistor for providing said first reference voltage, a second resistor which can be inserted in parallel with said first resistor for providing said second reference voltage, and switching means for switching said second resistor to be in parallel with said first resistor after a predetermined time from the receipt of said driving signal, said switching means also interrupting the parallel connection between said second resistor and first resistor when said driving signal ends;

a detecting resistor connected to said electromagnetic winding for detecting current flowing through said electromagnetic winding and providing a detected voltage representative thereof;

comparison amplifier circuit means responsive to said driving signal, for supplying as an output a first analog control output or a second analog control output, said comparison amplifier circuit means receiving said detected voltage and either one of said first or second reference voltages, providing said first analog control output when receiving said first reference voltage, said first analog control output causing the difference between said first reference voltage and said detected voltage to approach zero, and providing said second analog control output when receiving said second reference voltage, said second analog control output causing the difference between said second reference voltage and said detected voltage to approach zero, said comparison amplifier circuit means including a feedback circuit having a zener diode; and driving circuit means, responsive to said first and second analog control outputs for controlling a starting current flowing through said electromagnetic winding at a substantially constant value in accordance with said first analog control output and for controlling a holding current flowing through said electromagnetic winding at another substantially constant value in accordance with said second analog control output, said holding current being lower in value than said constant value of said starting current.

* * * * *